United States Patent [19]

Yamane et al.

[11] Patent Number: 4,878,869

[45] Date of Patent: Nov. 7, 1989

[54] TOYS HAVING MAGNETIC SWITCHES

[75] Inventors: Yuji Yamane; Hideya Nishikawa, both of Tokyo, Japan

[73] Assignee: Tomy Kogyo Co., Inc., Tokyo, Japan

[21] Appl. No.: 204,342

[22] Filed: Jun. 9, 1988

[30] Foreign Application Priority Data

Oct. 22, 1987 [JP] Japan ..... 62-161715

[51] Int. Cl.[4] ..... A63H 33/26; A63H 13/20; F17D 19/00

[52] U.S. Cl. ..... 446/130; 446/136; 74/DIG. 4; 192/84 PM; 272/31 R

[58] Field of Search ..... 446/130, 129, 131, 132, 446/133, 134, 135, 136, 139, 485; 74/DIG. 4; 192/84 PM; 272/31 R, 46, 49

[56] References Cited

U.S. PATENT DOCUMENTS

| | | | |
|---|---|---|---|
| 1,388,232 | 8/1921 | Zsarnay | 272/31 R |
| 2,659,998 | 11/1953 | Cavanaugh | 446/134 |
| 3,411,237 | 11/1968 | Crossman | 446/132 |
| 3,466,795 | 9/1969 | Friedman | 446/134 |
| 3,471,143 | 10/1969 | Lakin | 272/31 R |
| 3,596,401 | 8/1971 | Camire | 446/130 |
| 3,798,833 | 3/1974 | Campbell | 446/130 |
| 3,803,735 | 4/1974 | Stubbmann | 446/129 X |
| 3,916,939 | 11/1975 | Gillard | 192/84 PM X |
| 4,757,946 | 7/1988 | Johnson | 446/130 X |

FOREIGN PATENT DOCUMENTS

| | | | |
|---|---|---|---|
| 1048527 | 1/1959 | Fed. Rep. of Germany | 446/129 |

*Primary Examiner*—Robert A. Hafer
*Assistant Examiner*—D. Neal Muir
*Attorney, Agent, or Firm*—Staas & Halsey

[57] ABSTRACT

A toy having a movable element is provided with a magnetic actuator which includes a magnet that is placed in proximity to a magnetically attractable component of a transmission disposed within the toy for transmitting power from a motor to the movable element of the toy. The magnet is embedded in a play piece which is placed on the toy on a designated area in proximity to the magnetically attractable component.

8 Claims, 3 Drawing Sheets

FIG. 5
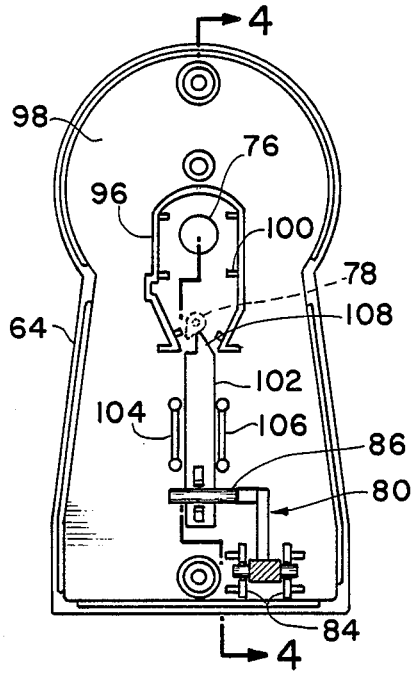
FIG. 6
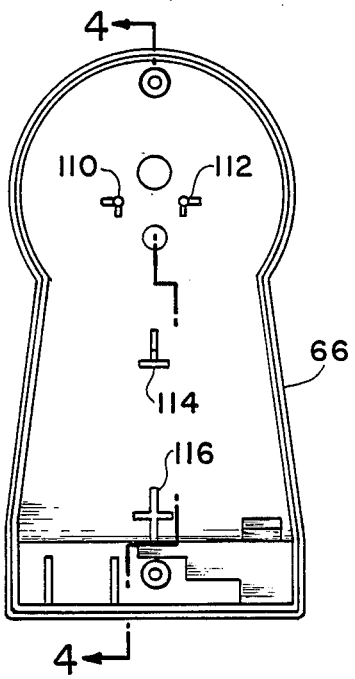
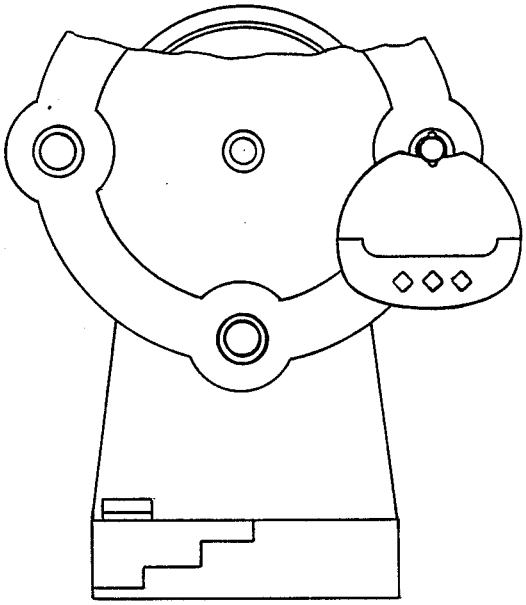
FIG. 7
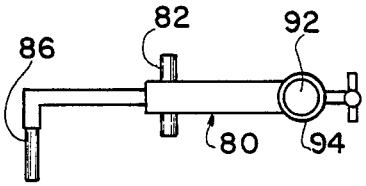
FIG. 8

TOYS HAVING MAGNETIC SWITCHES

BACKGROUND OF THE INVENTION

1. Field of the Invention

The present invention relates generally to toys having movable elements, and more particularly, to a drive mechanism having a magnetic switch for connecting the power output of a motor to a movable element of the toy.

2. Description of the Related Art

Toys having movable elements are known to include transmissions for transmitting driving force from a motor to the movable element or elements. Typically, to engage the transmission and thereby move the movable element, a control knob, switch, or lever is moved in and out of the transmission to prevent the transmission from transmitting a driving force to the moving element. The switch is usually provided on the main body of the toy for movement by hand to ON and OFF positions. A projection of the lever extends through the body to physically abut a portion of the drive train. The lever-type switch is particularly well suited for toys that locomote, wherein a switch on the body of the toy is engaged by an engaging projection upstanding from a track. Although the lever-type switch is suitable for toys movable on tracks, the switch is unsuitable for other types of toys, particularly those which are supported on a stationary base and have elements movable relative to the stationary base.

SUMMARY OF THE INVENTION

An object of the present invention is to provide a switch for a toy having movable elements, wherein the driving force is delivered without having to manually manipulate an ON and OFF switch.

Another object of the invention is to provide a switch which is actuated independently of a control knob.

Another object of the invention is to provide a switch which is relatively simple in construction and cost effective to produce.

The present invention meets the aforementioned objects by providing a switch which is actuated by magnetic attraction between a magnet located outside the toy and magnetic material located inside the toy. The magnet is preferably embedded in the bottom of a play piece or doll having an animal shape. In one embodiment, the magnet attracts magnetic material in a transmission and causes a gear to move upwardly into a power path of the transmission to impart movement to the moving element of the toy.

In another embodiment, a lever inside the toy moves by magnetic attraction to a magnet outside the toy in order to stop the output of a drive motor.

These and other features and advantages of the drive mechanism of the invention will become more apparent with reference to the following detailed description and drawings.

BRIEF DESCRIPTION OF THE DRAWINGS

FIG. 5 is a front view of one of two shell members of the FIG. 3 embodiment;

FIG. 6 is a rear view of the other of two shell members of the FIG. 3 embodiment;

FIG. 7 is a front view, partially cut-away, of the FIG. 3 embodiment; and FIG. 8 is a top view of the lever used in the FIG. 3 embodiment.

DETAILED DESCRIPTION OF THE PREFERRED EMBODIMENTS

Figure 1:
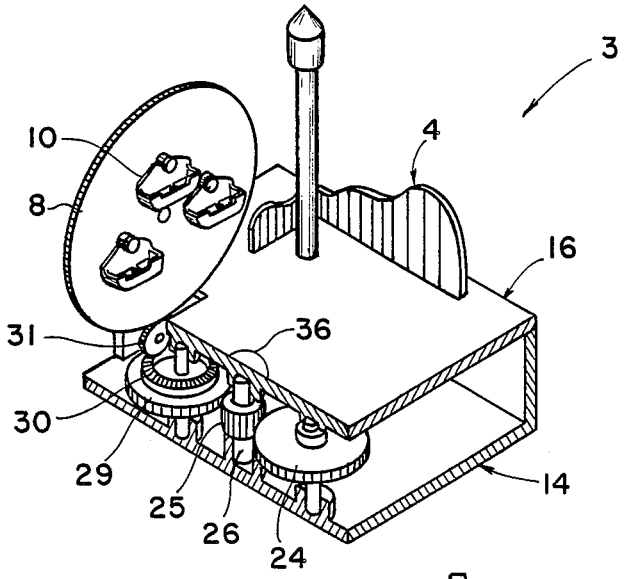
FIG. 1 is a perspective view, partially cut-away, showing a first preferred embodiment of the toy having a magnetic switch of the present invention.
Figure 2:
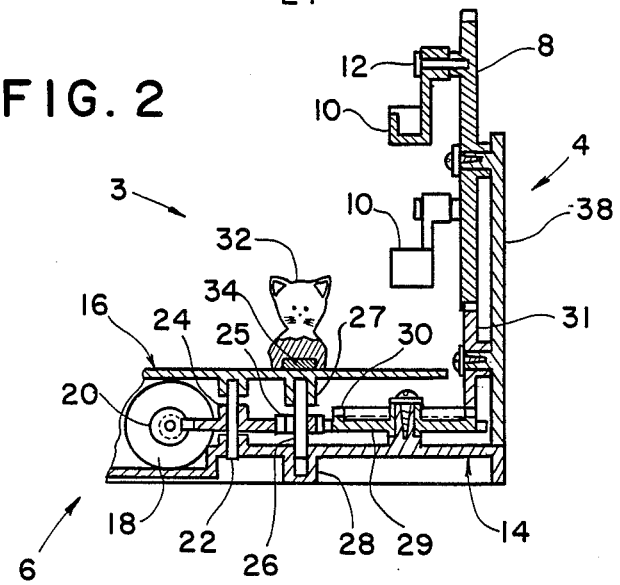
FIG. 2 is a cross-sectional view of the embodiment of FIG. 1.
Figure 3:
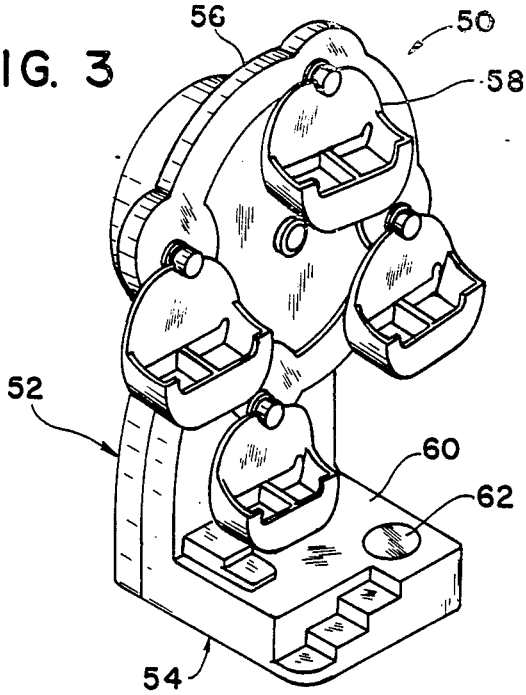
FIG. 3 is a perspective view of another preferred embodiment of the toy having a magnetic switch of the present invention.

Referring to FIGS. 1 and 2, a toy 3 has a vertical portion 4 and horizontal portion 6. The vertical portion 4 rotatably supports a rotatable wheel 8. The rotatable wheel 8 constitutes the moving element of the toy 3, and carries a plurality of carriages 10 which are symmetrically spaced around the center of the rotatable wheel 8. The carriages 10 pivot as the rotatable wheel 8 rotates so as to always face upwardly in a manner similar to a ferris wheel. Each carriage 10 is mounted on a shaft 12 for pivotal movement.

The horizontal portion 6 includes a bottom wall 14 and a parallel, spaced apart top wall 16. The space between the bottom wall 14 and top wall 16 is used to house a drive mechanism for rotatably driving the rotatable wheel 8.

The drive mechanism includes a motor 18 which outputs a rotational force to an output pinion gear 20. Gear 20 meshes with gear 24 which is rotatable about shaft 22. Pinion gear 25 connected to shaft 26 which is rotatable and axially slidable between upper and lower cylindrical bearings 27 and 28, respectively. Pinion gear 25 meshes with gear 24 and gear 29 when in its uppermost position. Gear 29 which is rotatably supported on a shaft integrally formed with the bottom wall 14, and has circumferential gear teeth for meshing with gear 25 and bevel teeth 30 which mesh with circumferential gear teeth of gear 31. The circumferential gear teeth of gear 31 mesh of with circumferential gear teeth provided on the circumference of the rotatable wheel 8. Torque delivered by the motor 18 is transmitted by gears 20, 24, 25, 29 and 31 to the rotatable wheel 8 in a rotational mode of operation.

In the non-rotational mode of operation, shaft 26 and pinion gear 25 are disposed in a downward-most position in which the lower end of the shaft 26 substantially bottoms out in the lower cylindrical bearing 28. The shaft 26 and pinion gear 25 are normally disposed in the bottom-most disposition by virtue of gravity.

A play piece 32 shaped in the form of a fictitious character or animal, such as a cat, has a magnet 34 embedded in a bottom thereof. The shaft 26 is made of a material which is magnetically attractable, such as a metal. To engage the drive train, the play piece 32 is placed in a position designated by an indicator mark 36 provided on an upper surface of the top wall 16. The magnet 34 attracts the shaft 26 and causes the same to move axially upwardly to a position where the pinion gear 25 is disposed in a meshing relationship with gears 24 and 29.

The motor 18 may be any type of motor which is capable of producing rotary force or torque deliverable to a moving element of a toy. The motor may be electrical or mechanical.

In the embodiment of FIGS. 1 and 2, gears 24, 25, 29, and 31 constitute a transmission which has an interruptible power path due to the axial movement of gear 25. The magnet 34 embedded in the play piece 32 and the magnetic material associated with gear 25 act as an actuator or magnetic switch for engaging the transmission. Although the play piece 32 is used to actuate the transmission, and thereby the drive mechanism, there is no physical connection between the play piece 32 and any component of the transmission.

The gears shown in FIGS. 1 and 2 may be alternatively mounted for rotation with a rotatable shaft or may be rotatable about stationary shafts, such as those illustrated in FIG. 2 which extend radially from a side wall 38 of the vertical portion 4.

The upper surface of the top wall 16 may be provided with props 40 which help simulate an amusement park setting.

The axially movable shaft 26 and gear 25 provide an effective means for engaging the transmission so that rotary force is delivered to the rotatable wheel 8 from the motor 18. While the embodiment of FIGS. 1 and 2 illustrate only one movable element of the toy, i.e., the rotatable wheel 8, other movable elements or elements of the toy may be connected to the same transmission and may therefore be actuated through the same means.

Another embodiment of the present invention is illustrated in FIGS. 3–8. A toy 50 has a vertical portion 52 and a horizontal base portion 54. The vertical portion 52 rotatably supports a wheel 56 which carries a plurality of pivotally connected carriages 58. The base portion 54 has a substantially horizontal planar surface 60 which includes an indicator mark 62 indicating an area of the planar surface 60 upon which a magnetic play piece (such as element 32 of FIG. 2) is placed to activate the drive mechanism.

Figure 4:
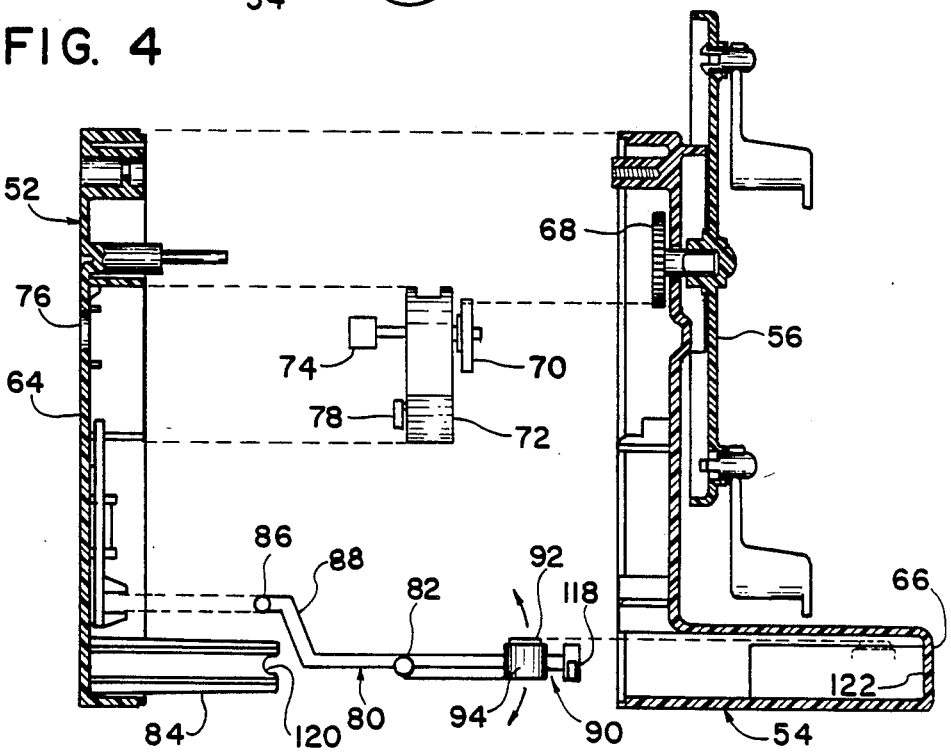
FIG. 4 is an exploded, cross-sectional view of the embodiment shown in FIG. 3.

Referring to FIG. 4, the vertical portion 52 and the horizontal base portion 54 are formed by two shell members 64 and 66 which are connected to each other by threaded fasteners (not shown).

Gear 68 connected to the wheel 56 meshes with gear 70 connected to the output shaft of mechanical motor 72. Motor 72 has a winding stem 74 which extends outwardly from the outer surface of shell member 64 through an opening 76. The mechanical motor 72 has an internal spring (not shown) which is wound by the winding stem 74. A transmission (also not shown) internal to the motor 72 converts the spring force into a rotary output at the gear 70 and also at catch 78. The two outputs are interconnected through the transmission. A low speed/high torque output is delivered to gear 70, while a high speed/low torque output is delivered to catch 78. When the internal spring is wound, both gear 70 and catch 78 rotate until either the spring unwinds or catch 78 becomes obstructed by stopping means.

A lever 80 is pivotally supported at medial portion thereof by shaft 82 journalled in the ends of a pair of supports 84. The supports 84 are integrally formed with the shell member 64 and extend into shell member 66 when assembled. The lever 80 includes an integrally formed linkage 86 which extends radially outwardly at a right angle from an elevated end portion 88 of the lever 80. The opposite end portion 90 of the lever 80 carries magnetic element 92 which is made of magnetically attractable material and is housed in a housing 94 integrally formed with the lever 80.

Referring to FIG. 5, a motor cage 96 is integrally formed with and extends upwardly from an inner surface 98 of the shell member 64. Spacers 100 formed with the cage 96 also extend upwardly from the inner surface 98 such that when the motor 72 is placed in the cage, catch 78 is free to rotate between an inner surface of the motor and the inner surface 98 of the shell member 64. A sliding bar 102 is slidable upwardly and downwardly between parallel vertical guides 104 and 106. A pointed end 108 of the sliding bar 102 is movable into the rotary path of catch 78. Catch 78 is also pointed so as to "catch" on the pointed end 108 of the sliding bar 102 when the sliding bar 102 is moved axially upwardly.

When assembled, the end portion 90 of the lever 80 is disposed in a downward position due to gravity and the pivotal connection of shaft 82 in the supports 84 which act as a fulcrum. Linkage 86 is elevated when then end portion 90 is in the downward position. Elevation of the linkage 86 causes the sliding bar 102 to move into its uppermost position. In the upper-most position, the pointed end 108 of the sliding bar 102 abuts the catch 78 of the motor 72. Due to its low torque output, the catch 78 is stopped by touching the sliding bar 102. Thus, when the motor 72 is prevented from producing rotary output at the catch 78, gear 70 also ceases to rotate, and the wheel 56 ceases to rotate. When a play piece having a magnet disposed therein is placed on the indicator mark 62, the magnetic element 92 of the lever 80 is attracted to the magnet in the play piece, thereby causing end portion 90 of the lever 80 to move upwardly. When end portion 90 moves upwardly, linkage 86 at end portion 88 moves downwardly. Downward movement of the linkage 86 causes downward movement of the sliding bar 102 to a position where the pointed end 108 is no longer in the rotary path of the catch 78. With the motor 72 sufficiently wound, and the catch 78 unobstructed by the pointed end 108 of the sliding bar 102, the motor 72 produces rotary output at both the catch 78 and the gear 70. Rotation of the gear 70 causes the wheel 56 to rotate through gear 68. Removal of the play piece containing a magnet causes the end portion 90 of the lever 80 to drop. In response, the linkage 86 of the lever 80 moves upwardly and pushes the sliding bar 102 upwardly into the rotary path of the catch 78. Thus, rotation of the wheel 56 is prevented by the pointed end 108 of the sliding bar 102.

Motor 72, sliding bar 102 and the lever 80 are held in place by abutments formed in the opposite shell member 66. For example, abutments 110, 112 and 114 hold the motor (not shown in FIG. 5) n the cage 96. Abutment 114 and abutment 116 hold the sliding bar 102 in position, while protrusion 118 helps keep shaft 82 in a bearing portion 120 of the supports 84 by making sliding contact with an inner surface 122 of shell member 66.

Numerous modifications and adaptations of the drive mechanism of the present invention will be apparent to those so skilled in the art and thus, it is intended by the following claims to cover all such modifications and adaptations which fall within the true spirit and scope of the invention.

What is claimed is:

1. A toy comprising:

a body;

a movable element connected to the body;

spring mechanical drive motor means with rotary release means, and being operatively connected to the movable element for moving the movable element;

an actuator for selectively contacting and releasing the rotary release means;

a first magnetic member linked to said actuator; and a second magnetic member for placement in contact with the body and being operative to move the actuator into and out of contact with the rotary release means by magnetic attraction with the first magnetic member, so that when the actuator is out of contact with the rotary release means, the drive motor outputs a rotary driving force to the movable element.

2. A toy according to claim 1, wherein the body has a vertical portion for supporting the movable element and a horizontal portion for housing the drive motor.

3. A toy according to claim 2, wherein one of the magnetic members is a piece of magnetic material carried by a distal end portion of a lever pivotally supported inside the body, the opposite end portion being linked to the actuator which is movable in response to movement of the lever into and out of engagement with an output member of the motor, and the other of the magnetic members is a magnet movable outside the body into and out of proximity to the magnetic material of the lever to magnetically move the lever.

4. A toy according to claim 1, wherein the motor is a spring-wound motor having a low speed/high torque output for driving the movable element and a high speed/low torque output comprises the rotary release means.

5. A toy comprising:

a body;

a rotatable wheel rotatably supported by the body;

spring mechanical drive motor means with rotary release means, and being operatively connected to the rotatable wheel for rotating the rotatable wheel;

an actuator for selectively contacting and releasing the rotary release means;

a first magnetic member linked to said actuator; and a second magnetic member for placement in contact with the body and being operative to move the actuator into and out of contact with the rotary release means by magnetic attraction with the first magnetic member, so that when the actuator is out of contact with the rotary release means, the drive motor outputs a rotary driving force to the movable element.

6. A toy according to claim 5, wherein the body includes a substantially horizontal portion and a substantially vertical portion extending upwardly from the horizontal portion.

7. A toy according to claim 6, further comprising a lever having a proximal end, a distal end, and a medial portion, and being pivotally connected at the medial portion to support means within the body, and having the first magnetic member disposed at the distal end and a linkage integrally formed at the proximal end, the linkage being operatively connected to a sliding bar, and the second magnetic member is movable outside the body to a position near the magnetic material of the lever for moving the lever by magnetic attraction, movement of the lever causing movement of the sliding bar through the linkage so that the sliding bar disengages and thereby releases the rotary release means which is permitted to rotate freely by the high speed/low torque output of the drive motor.

8. A toy according to claim 5, wherein the motor is a spring-wound motor having a low speed/high torque output for driving the movable element and a high speed/low torque output comprises the rotary release means.

* * * * *